United States Patent [19]

Gehring et al.

[11] Patent Number: 4,922,970

[45] Date of Patent: May 8, 1990

[54] WEFT THREAD INSERTING GRIPPER HAVING A GUIDE ELEMENT FOR A SHUTTLELESS LOOM

[75] Inventors: Fritz Gehring, Bodolz; Valentin Krumm, Hergensweiler, both of Fed. Rep. of Germany

[73] Assignee: Lindauer Dornier Gesellschaft mbH, Lindau/Bodensee, Fed. Rep. of Germany

[21] Appl. No.: 371,453

[22] Filed: Jun. 26, 1989

[30] Foreign Application Priority Data

Jul. 25, 1988 [DE] Fed. Rep. of Germany ..... 3825230
Jan. 20, 1989 [DE] Fed. Rep. of Germany ..... 3901549

[51] Int. Cl.[5] ..... D03D 47/18
[52] U.S. Cl. ..... 139/446; 139/449
[58] Field of Search ..... 139/440, 441, 444, 445, 139/446, 447, 448

[56] References Cited

U.S. PATENT DOCUMENTS 3,487,859 1/1970 Piccoli ..... 139/446
3,613,740 10/1971 Geiger ..... 139/448
4,040,453 8/1977 Juillard et al. ..... 139/446
4,699,183 10/1987 Menzel .

FOREIGN PATENT DOCUMENTS 190266 12/1922 United Kingdom ..... 139/146

*Primary Examiner*—Henry S. Jaudon
*Attorney, Agent, or Firm*—W. G. Fasse; D. H. Kane, Jr.

[57] ABSTRACT

A weft thread inserting gripper for a loom is equipped with a guide element attached to a side wall of the gripper. In order to enable the guide element to properly contact the reed when the gripper moves in the loom shed, the guide element and gripper combination is so constructed that at least the guide element can tilt about a journal axis extending in parallel to the direction of gripper movement. This tilting ability can be achieved by mounting the guide element itself to a gripper side wall for pivoting about the journal axis. The same tilting effect can be achieved by mounting the entire gripper side wall carrying the guide element on such a journal axis. Both possibilities assure an optimal surface contact between the guide element and the respective surface in the loom to provide a quiet and smooth gripper motion.

14 Claims, 4 Drawing Sheets

WEFT THREAD INSERTING GRIPPER HAVING A GUIDE ELEMENT FOR A SHUTTLELESS LOOM

FIELD OF THE INVENTION

The invention relates to a weft thread inserting gripper having a guide element for a shuttleless loom. Such grippers are attached to gripper rods which move back and forth into the loom shed.

BACKGROUND INFORMATION

Such grippers are equipped with a guide element which is replaceably attached to a side wall of the gripper. The guide element is subject to substantial wear and tear since it slides along the reed as the gripper moves back and forth for the weft thread insertion. Therefore, it is desirable to make the mounting and the guide element easily replaceable. Thus, it is known to provide the connection between the guide element and the gripper housing proper by means of an elastic clamp having a head, a reduced diameter neck, and a clamp body. A bore in a gripper housing side wall aligns with a bore in the guide element and the elastic clamp is inserted into these bores so that the reduced diameter neck portion can perform the clamping action with the head resting against the side wall of the gripper housing. This side wall is referred to as the guided side wall because it bears against the reed through the guide element during the gripper movements. At least two of these elastic clamps are used for securing the guide element to the guided side wall of the gripper housing. The heads of the elastic clamps function substantially in the same manner as a rivet head by resting against the inner surface of the guided side wall. The clamps are made of rubber or the like.

U.S. Pat. No. 4,699,183 (Menzel) discloses the above mentioned rubber or elastic clamps for the mounting of replaceable components in a loom.

It has been found that the guide element or rather the gripper itself has a tendency to perform a small tilting movement as it enters into the loom shed. As a result, the small surface contact with the reed and hence wear and tear are increased, especially in specific areas if the entire guide element cannot yield.

OBJECTS OF THE INVENTION

In view of the foregoing it is the aim of the invention to achieve the following objects singly or in combination:

- to construct a gripper head with its guide element in such a way that the guide element will be able to contact the reed with its entire reed facing surface or at least with as large a surface area as possible to minimize wear and tear;
- to construct the guide element and/or its attachment to the gripper body in such a way that it can easily follow any tilting movements when the gripper head moves back and forth in the loom shed; and
- to take advantage of the elastic mounting of the guide element to the gripper body side wall in permitting such tilting movements.

SUMMARY OF THE INVENTION

A gripper as described above is characterized according to the invention in that the guide element is so constructed and secured to a side wall of the gripper body that the guide element can tilt about an axis which extends substantially in parallel to the longitudinal axis of the gripper that is in parallel to the direction of weft thread insertion. Thus, the tilting direction extends clockwise and/or counterclockwise around the tilting axis.

It is an important advantage of the invention that during the controlled movement of the gripper into the loom shed and out of the loom shed the guide element can align itself relative to the stationary reed so that the contact area between the reed and the guide element is optimally enlarged. As a result, the gripper motion is smooth and quiet.

Several possibilities are provided for the tiltable mounting of the guide element on the side surface of the gripper body. According to a first embodiment, a wedge-shaped recess is provided between a surface of the guide element and the surface of the gripper body side wall. This wedge-shaped recess can be provided either by a slanted wall of the guide element or by a slant in the gripper body side wall. The wedge-shaped recess makes it possible for the guide element to tilt because the elastic clamp or clamps securing the guide element to the gripper body side wall will sufficiently yield to permit such tilting movement within the range of the wedge-shaped recess. The tilting movement takes place automatically in response to the contact of the guide element with the reed.

The tilting takes place about an axis which extends substantially in parallel to the longitudinal axis of the gripper body. Preferably, the tilting axis extends centrally through the neck portion of the elastic clamps securing the guide member to the gripper side wall.

Instead of one or two recesses or in combination therewith a washer-type elastic material insert may be placed between the gripper body side wall and the guide element. It has been found that a synthetic foam insert or a rubber insert or the like alone will permit the desired tilting movement of the guide element. However, as mentioned, the recess or recesses may be used in combination with the elastic material insert.

The tilting movement will also be accomplished if the guide element is supported at both of its ends by respective journal bearings which in turn are mounted in supports secured to the gripper side wall. In this embodiment the elastic clamps can be avoided since an easy replacement of the guide element is possible with the aid of the journal bearings. The journal bearings may comprise one through-going shaft or two bearing studs. In both possibilities the bearing would be a sleeve-type bearing which is supported by the respective bearing support.

Still another embodiment involves constructing the guide element with an elastic insert between two hard covers to form a sandwich type structure. The elastic insert again will permit a required tilting movement at least of that portion of the guide element which contacts the reed so that the required alignment between the stationary reed and the moving guide element is assured.

In still another embodiment the guide element may be elastically or rigidly secured to the side wall which in turn is journalled to the gripper body. In this embodiment the gripper body side wall and the guide element form a unit which aligns itself automatically relative to the reed substantially in the same manner and with the same effect as described above for the other embodiments. Preferably, the journalled gripper body side wall is connected through a spring to the gripper body.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
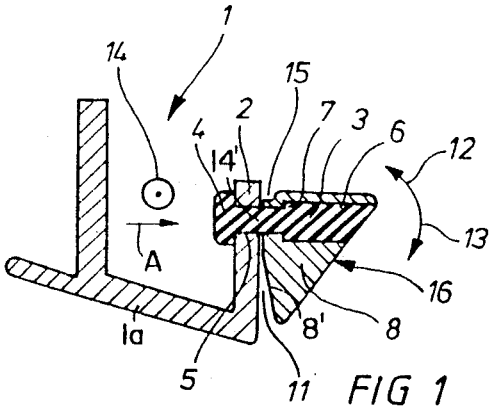
FIG. 1 is a sectional view along section line 1—1 in FIG. 2.
Figure 2:
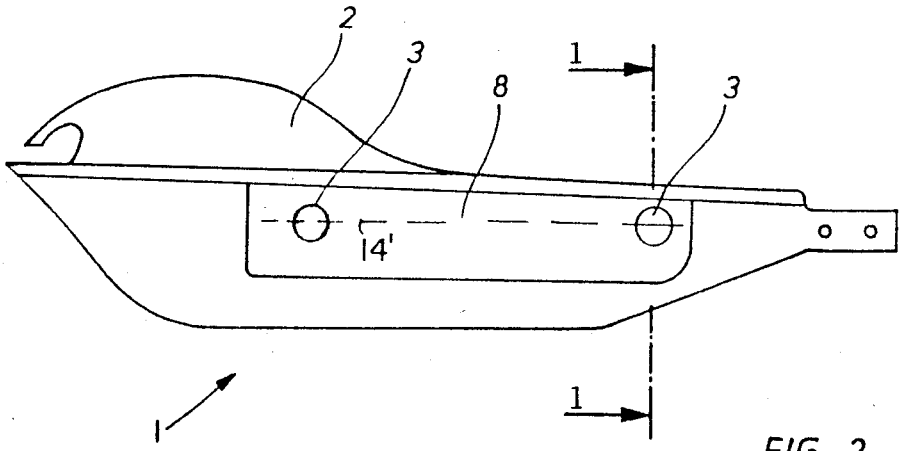
FIG. 2 is a side view in the direction of the arrow A in FIG. 1.

Referring to FIGS. 1 and 2, the gripper 1 comprises a gripper body 1*a* having a side wall 2 guided by a guide element 8. The guide element 8 is secured to the side wall 2 by an elastic clamp 3 made of any suitable material. The clamp 3 has a rivet-type head 4 resting against the inner surface of the wall 2. The clamp 3 further has a neck portion and a body portion 6. The wall 2 is provided with a bore 5 through which the neck fits. The body 6, due to its larger diameter than the neck diameter, rests against a shoulder 7 to thereby tightly, yet elastically clamp the guide element 8 to the side wall 2. The material of the guide element 8 is sufficiently elastic to squeeze, for example, the head 4 through the bore 5. The guide element 8 may be made of any suitable material. A cotton webbing impregnated by phenolic resin is suitable for the present purposes, for example.

When the mounting is completed, the bores 5 and 6 are filled with the material of the elastic clamp or rubber clamp 3. Replacement of a worn guide element 8 is easily accomplished by severing the neck of the elastic clamp 3 and by mounting a new guide element to the side wall 2.

According to the invention it is intended to enable the guide element 8 to tilt in the direction of the double arrow 12, 13. Such tilting takes place about an axis 14' extending substantially in parallel to the longitudinal axis 14 of the gripper body 1*a*. The tilting axis 14' passes centrally through the neck of each of the elastic clamps 3. The first axis 14 corresponds to the weft thread insertion direction and the second axis 14' extends substantially in parallel to said movement direction. Both axes extend perpendicularly to the plane of the drawing sheet.

The above mentioned tilting movement as indicated by the arrows 12 and 13 is accomplished in FIG. 1 by a recess 11 formed between the side wall 2 and a slanted surface portion 8'. The wedge-shaped recess 11 opening downwardly in combination with the elasticity of the neck of the elastic clamp 3 enable the tilting motion in the direction of the arrow 13. A further recess 15 above the neck portion enables a tilting motion in the direction of the arrow 12. In the further embodiment shown in FIG. 3 an insert 10 of elastic material is provided between the side wall 2 and the guide element 3. The neck of the elastic clamp 3 also passes through the elastic insert 10. The elastic insert 10 makes possible the intended tilting motion as indicated by the arrows 12, 13 in FIG. 1 also in FIG. 3. The insert 10 is, for example, made of synthetic foam materials, rubber, or any suitable elastomeric material so that it can be easily compressed while elastically yielding to the tilting movements of the guide element 9.

Figure 8:
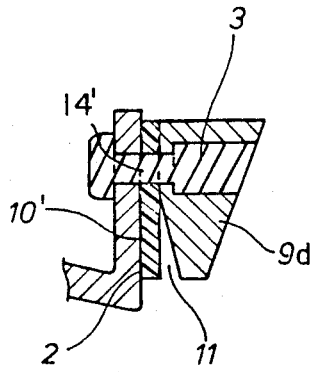
FIG. 8 is a sectional view through an embodiment with a wedge-shaped recess and an elastic insert.
Figure 9:
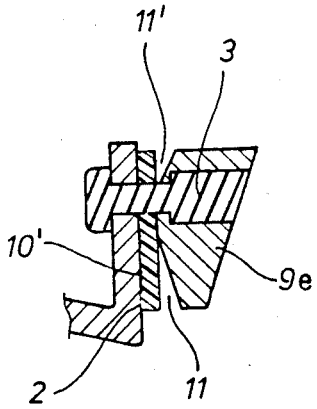
FIG. 9 is a view similar to that of FIG. 8, but showing two wedge-shaped recesses.

The embodiments of FIGS. 1 and 3 may be combined as shown in FIGS. 8 and 9 which will be described in more detail below. In all of these embodiments it is the important advantage of the invention that the gripper, during its controlled motion, has a substantially smoother and more quiet run than was possible heretofore. This improvement has been achieved by the effect that the running surfaces 16, 16' of the guide elements 8, 9 are now enabled to fully contact the reed. Further, it is possible to equip the inserting gripper head and the withdrawing gripper head with the tilting features according to the invention.

Figure 4:
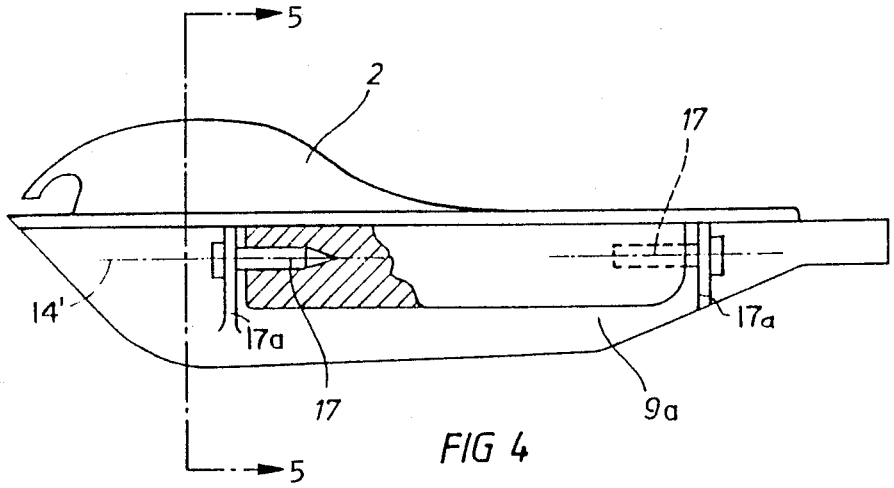
FIG. 4 is a side view similar to that of FIG. 2 with a guide element shown partially in section and supported by journal bearings.
Figure 5:
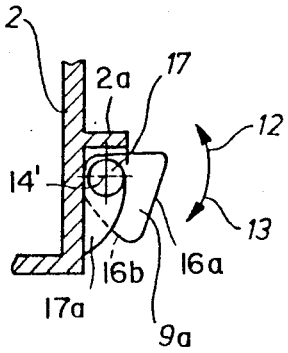
FIG. 5 is a sectional view along section line 5—5 in FIG. 4.

FIGS. 4 and 5 show a further embodiment in which the guide element 9*a* is mounted for a tilting movement by journal bearings or shafts 17 mounted in bearing supports 17*a* connected to the gripper body, for example, to the side wall 2'. The journal bearing shafts or studs 17 are axially aligned with each other along the tilting axis 14' shown as a dot in FIG. 1. The guide element 9*a* has a reed contacting surface 16*a* and a slanted or even curved surface 16*b* which permits the tilting movement as indicated by the double arrow 12, 13. A projection 2*a* extending from the gripper body side wall 2 may optionally be provided for limiting a tilting motion in the direction of the arrow 12. The studs 17 may also be embodied by a through-going shaft and the studs or shaft ends may either journal in the supports 17*a* or in the guide element 9*a* to enable the tilting movement.

Figure 6:
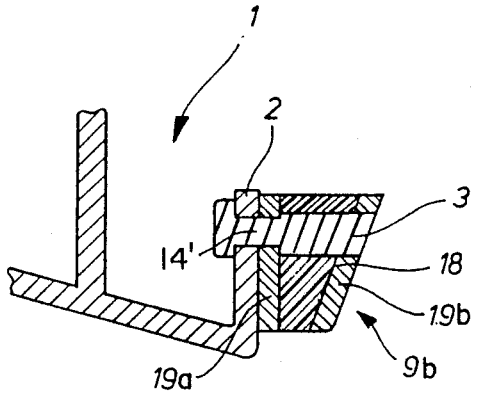
FIG. 6 is a sectional view similar to that of FIG. 1 showing a further embodiment with a sandwich-type guide element.

FIG. 6 illustrates a guide element 9*b* in which an elastic relatively soft inner core 18 is sandwiched between a rigid substrate 19*a* and an outer guide layer 19*b* forming the guide surface. The connection to the side wall 2 with the elastic clamping element 3 is the same as, for example, in FIG. 1. Due to the elastic core 18 the guide element 9*b* is capable of yielding in a tilting motion to any impacts on the reed. Thus, an alignment between the reed and the guide surface of the outer layer 19*b* is achieved with an optimal surface contact. The elasticity of the clamp 3 with the elasticity of the core 18 cooperate in achieving the desired tilting and alignment movement of the guide element 9*b* relative to the reed. Adhesive bonding may be used in the sandwich structure.

Figure 7:
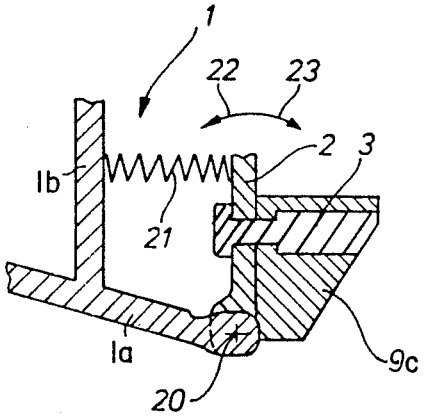
FIG. 7 is a sectional view showing an embodiment with a journalling side wall of the gripper body to which the guide element is attached for tilting together with the side wall.

FIG. 7 illustrates another embodiment in which the guide element 9*c* is secured by the elastic clamp 3 to a tiltable side wall 2'. The side wall 2' is journalled by a journal shaft 20 to the housing 1*a* of the gripper 1. The tilting motion in the direction of the double arrow 22, 23 is permitted by the journal shaft 20. Preferably, but not necessarily, a spring 21 is arranged between a wall 1*b* and the wall 2' to normally hold the wall 2' and the guide element 9*c* in a non-tilted position. However, the spring 21 is sufficiently elastic to permit the desired tilting movements. When no adjustment or tilting movement is needed, the spring 21 will hold the guide element 9*c* in a substantially neutral position as shown.

Figure 3:
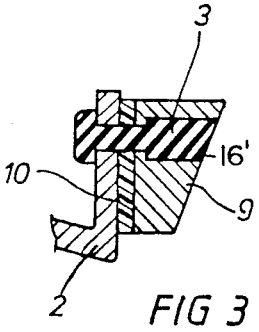
FIG. 3 illustrates a modified embodiment compared to FIG. 1, with an elastic insert.

FIG. 8 shows a combination of the embodiments of FIGS. 1 and 3 except for the upper recess 15 shown in FIG. 1. FIG. 9 shows a combination in which in addition to the downwardly open recess 11 an upwardly open wedge-shaped recess 11' is provided to facilitate a larger tilting movement range.

The guide element 9*d* of FIG. 8 can tilt due to the wedge-shaped recess 11, due to the elasticity of the insert 10', and due to the elasticity of the clamp 3. Additionally, the insert 10' functions as a damper against hard impacts without interfering with the tilting motion about the tilting axis 14'. Due to the additionally upwardly open wedge-shaped recess 11' the guide element 9*e* of FIG. 9 has the largest tilting range combined with an effective damping of any excessive tilting motions.

According to the invention, any of the above described features may be combined with each other for the intended purpose of permitting the required tilting movement. For example, the embodiment of FIGS. 4 and 5 may also be provided with an elastic damping element to smooth out excessive damping movements.

Although the invention has been described with reference to specific example embodiments, it will be appreciated, that it is intended, to cover all modifications and equivalents within the scope of the appended claims.

What we claim is:

1. A weft thread inserting gripper for a shuttleless loom, said gripper comprising a gripper body having a first longitudinal axis and a guided side wall for guiding said gripper on its back and forth movements along a reed in a loom shed, a guide element, means for attaching said guide element to said guided side wall so that said guide element can contact said reed, and means arranged for permitting a tilting movement of said guide element around a second longitudinal axis extending substantially in parallel to said first longitudinal axis of said gripper body.

2. The gripper of claim 1, wherein said attaching means comprise at least one elastic mounting member for securing said guide element in an elastically yielding manner to said guided side wall of said gripper body, said elastic mounting member forming a tilting bearing for permitting said tilting movement.

3. The gripper of claim 1, wherein said means for permitting said tilting movement comprise at least one slanted wall, so that a wedge-shaped recess is formed between said slanted wall and said guided side wall of said gripper body, whereby said guide element is enabled to perform said tilting movement.

4. The gripper of claim 3, wherein said slanted wall is part of said guide element.

5. The gripper of claim 3, wherein said slanted wall is part of said guided side wall of said gripper body.

6. The gripper of claim 1, wherein said means for permitting a tilting movement comprise an elastic insert (10) between said guide element and said guided side wall of said gripper body.

7. The gripper of claim 1, wherein said means for permitting a tilting movement comprise journal bearing means for tiltably supporting said guide element, and wherein said means for attaching comprise journal bearing support means connected to said gripper body for supporting said journal bearing means to permit said tilting movement about said second axis.

8. The gripper of claim 1, wherein said guide element comprises a hard substrate, a hard cover layer, and an elastic intermediate insert sandwiched between said hard substrate and said hard cover layer.

9. The gripper of claim 1, wherein said attaching means secure said guide element to said guided side wall, and wherein said means for permitting a tilting movement comprise journal means for tiltably securing said guided side wall to said gripper body, so that said guided side wall and said guide element can tilt together.

10. The gripper of claim 9, further comprising spring means operatively mounted between said guided side wall and said gripper body, said spring means normally supporting said side wall and said guide element in a neutral position and yielding to said tilting movement.

11. The gripper of claim 1, wherein said means for permitting said tilting movement comprise an elastic insert (10') between said guide element and said guided side wall of said gripper body, and at least one slanted wall forming part of said guide element and facing said elastic insert so that at least one wedge-shaped recess is formed between said elastic insert and said slanted wall of said guide element.

12. The gripper of claim 11, wherein said wedge-shaped recess opens downwardly.

13. The gripper of claim 11, wherein said wedge-shaped recess opens upwardly.

14. The gripper of claim 9, wherein said guide element comprises two slanted wall portions, one slanting upwardly, the other slanting downwardly, so that two wedge-shaped recesses are formed, one wedge-shaped recess opening upwardly, the other wedge-shaped recess opening downwardly.

* * * * *